US007743926B2

(12) United States Patent
Lewis-Gray

(10) Patent No.: US 7,743,926 B2
(45) Date of Patent: Jun. 29, 2010

(54) MAGNETIC SEPARATION METHOD

(75) Inventor: Alexander Hamilton Lewis-Gray, Ballarat (AU)

(73) Assignee: GEKKO Systems Pty Ltd, Ballarat, Victoria (AU)

( * ) Notice: Subject to any disclaimer, the term of this patent is extended or adjusted under 35 U.S.C. 154(b) by 479 days.

(21) Appl. No.: 11/573,311

(22) PCT Filed: Aug. 18, 2005

(86) PCT No.: PCT/AU2005/001233

§ 371 (c)(1),
(2), (4) Date: Jul. 27, 2007

(87) PCT Pub. No.: WO2006/021024

PCT Pub. Date: Mar. 2, 2006

(65) Prior Publication Data

US 2008/0011650 A1 Jan. 17, 2008

(30) Foreign Application Priority Data

Aug. 24, 2004 (AU) ..... 2004904808

(51) Int. Cl.
*B03C 1/00* (2006.01)

(52) U.S. Cl. ..... 209/223.2; 209/38; 209/223.1; 209/225; 209/228

(58) Field of Classification Search ..... 209/223.2, 209/38, 223.1, 225, 228, 230, 232
See application file for complete search history.

(56) References Cited

U.S. PATENT DOCUMENTS 2,992,738 A * 7/1961 Maynard ..... 209/223.1
3,346,113 A * 10/1967 Lundmark ..... 209/223.1
3,856,666 A * 12/1974 Yashima et al. ..... 209/219
3,935,947 A 2/1976 Barrett
4,051,023 A * 9/1977 Fogle et al. ..... 209/223.2
4,125,191 A * 11/1978 Peace ..... 209/636
4,359,382 A * 11/1982 Morgan ..... 209/223.2
4,781,821 A * 11/1988 Salmi ..... 209/214
4,869,811 A 9/1989 Wolanski et al.
5,057,210 A 10/1991 Julius
5,377,845 A * 1/1995 Hamen et al. ..... 209/223.2
5,860,532 A 1/1999 Arvidson
6,149,014 A * 11/2000 Mankosa et al. ..... 209/223.2
6,722,503 B2 * 4/2004 Watters et al. ..... 209/38

FOREIGN PATENT DOCUMENTS

JP 09192529 7/1997
SU 1570778 6/1990

* cited by examiner

*Primary Examiner*—Patrick Mackey
*Assistant Examiner*—Luis Gonzalez
(74) *Attorney, Agent, or Firm*—Volpe and Koenig, P.C.

(57) ABSTRACT

A magnetic separator for a mineral feed comprising, a rotatable drum having an attraction surface, an inlet for receiving a stream of the mineral feed and directing it past the rotating drum, means for generating a magnetic field to attract magnetic components in the feed to the attraction surface, a first zone for take off of non-magnetic components of the mineral feed, and a second zone for take off of the magnetic components, wherein the magnetic field generating means are adapted to subject the magnetic components to at least one reversal of polarity of the magnetic field as the drum rotates.

12 Claims, 6 Drawing Sheets

MAGNETIC SEPARATION METHOD

FIELD OF THE INVENTION

This invention relates to a method for separating magnetic material from a feed. It also relates to a magnetic separator construction for performing the method of the invention.

BACKGROUND OF THE INVENTION

In industries such as the mining industry where it is necessary to employ crushers to crush rocks, it is common place for pieces of magnetic material forming part of the crushing equipment to break off and be mixed with the crushed rock. This magnetic material, if it is left mixed with the crushed rock feed, can cause substantial harm in any downstream processing of the crushed rock feed.

In many instances, magnetic separators are therefore employed immediately downstream of crushers to remove any magnetic material whether it has been broken off from the crushers during the crushing operation or incorporated from any other source.

In the gold mining industry in particular, rock is crushed whilst being mixed with water to form a slurry. This slurry may then be introduced into a magnetic separator and allowed to pool in contact with an attraction surface such as a drum. A magnet sitting behind the opposite surface of the drum attracts magnetic particles from the slurry. As the drum rotates beyond the magnet, these magnetic particles fall off into a collection area.

Whilst magnetic separation of slurries in this fashion has proven to be reasonably effective, particularly where the particles comprising the slurry are relatively fine, there are a number of problems associated with this technique.

For instance, where are a substantial number of coarse particles in the slurry, eg. particles in a range 5 mm to 50 mm, it has been found that this technique is not effective because the step of pooling the slurry causes the coarse particles and slurry to clump and hence interfere with flow of slurry past the rotating drum.

Even in situations where the particles are relatively fine, there may be difficulties associated with clumping of magnetic material on the attraction surface when it passes the edge of the magnet with the result that the magnetic material does not separate cleanly from the drum as it rotates.

A further concern relates to the fact that particles of magnetic material attached to the drum by virtue of their strong attachment can entrain a proportion of non-magnetic material from the slurry. As a result, this non-magnetic material may be harvested together with the magnetic material rather than in a separate stream free of magnetic material. Thus, valuable components of the slurry, eg. gold may be lost.

It is an object of the invention to provide a method and apparatus which addresses one or more of the aforesaid disadvantages.

DISCLOSURE OF THE INVENTION

The invention provides in one aspect a method of removing magnetic material from a feed comprising subjecting the feed to a magnetic field to attract the magnetic components of the feed to an attraction surface and, subjecting the magnetic components attracted to the attraction surface to at least one reversal of polarity of the magnetic field before separating a stream of the magnetic components from the attraction surface.

Suitably, the magnetic components are subjected to a plurality of reversals of polarity of the magnetic field.

The stream of magnetic components may be separated from the attraction surface by gradually decreasing the strength of the magnetic field used to attract the magnetic components to the attraction surface.

In a particular aspect of the invention, the attraction surface may comprise a rotating drum. The feed may comprise a slurry. The slurry may comprise a water based slurry.

In another aspect the invention provides a magnetic separator for a mineral feed comprising,

- a rotatable drum having an attraction surface,
- an inlet for receiving a stream of the mineral feed and directing it past the rotating drum,
- means for generating a magnetic field to attract magnetic components in the feed to the attraction surface,
- a first zone for take off of non-magnetic components of the mineral feed, and
- a second zone for take off of the magnetic components,
- wherein the magnetic field generating means are adapted to subject the magnetic components to at least one reversal of polarity of the magnetic field as the drum rotates.

The inlet may direct the mineral feed past the rotating drum by flowing it over the rotating drum.

The magnetic field may be generated by one or more magnets arranged behind the attraction surface. The magnet may comprise a permanent magnet or an electromagnet. It may comprise a combination of these two types of magnets.

The magnet may comprise a plurality of individual magnet segments. The magnet segments may be arranged in an arc generally following the interior surface of the rotating drum. One or more of the segments may have a polarity reversal compared with an adjacent segment. The magnetic strength of the segments may be varied. For example, the strength of the segments at the beginning of the arc where the feed first contacts the rotating drum and hence the attraction surface may comprise segments of higher magnetic strength. Towards the end of the arc, the segments may decrease in magnetic strength. Furthermore, towards the end of the arc, the segments may increase in separation from the attraction surface of the drum so as to decrease the strength of the magnetic field for attracting magnetic components to the drum and allowing the magnetic components to be separated more readily.

The magnetic separator may include sizing means. The sizing means may be arranged to separate the non-magnetic components into a fine stream and a coarse stream. Thus, the first outlet of the separator may be split into two outlets, namely a fines outlet and a coarse outlet.

The sizing screen may be mounted on a cover. The cover may be tiltable with respect to a housing forming part of the separator so as to allow access to the sizing screen. The sizing screen may be mounted in such a fashion as to allow its direction to be reversed.

Preferred aspects of the invention will now be described with reference to the accompanying drawings.

DETAILED DESCRIPTION OF THE PREFERRED EMBODIMENTS

Figure 1:
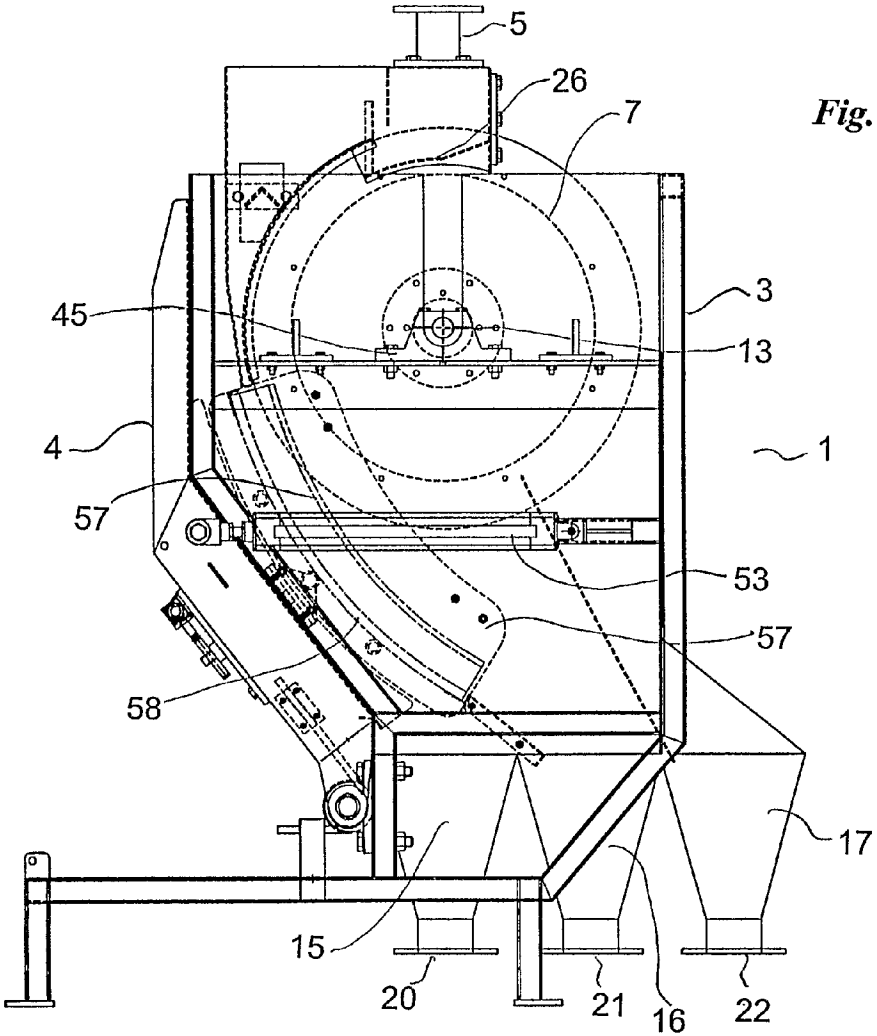
FIG. 1 shows a side on x-ray elevation of a magnetic separator constructed in accordance with the invention.
Figure 2:
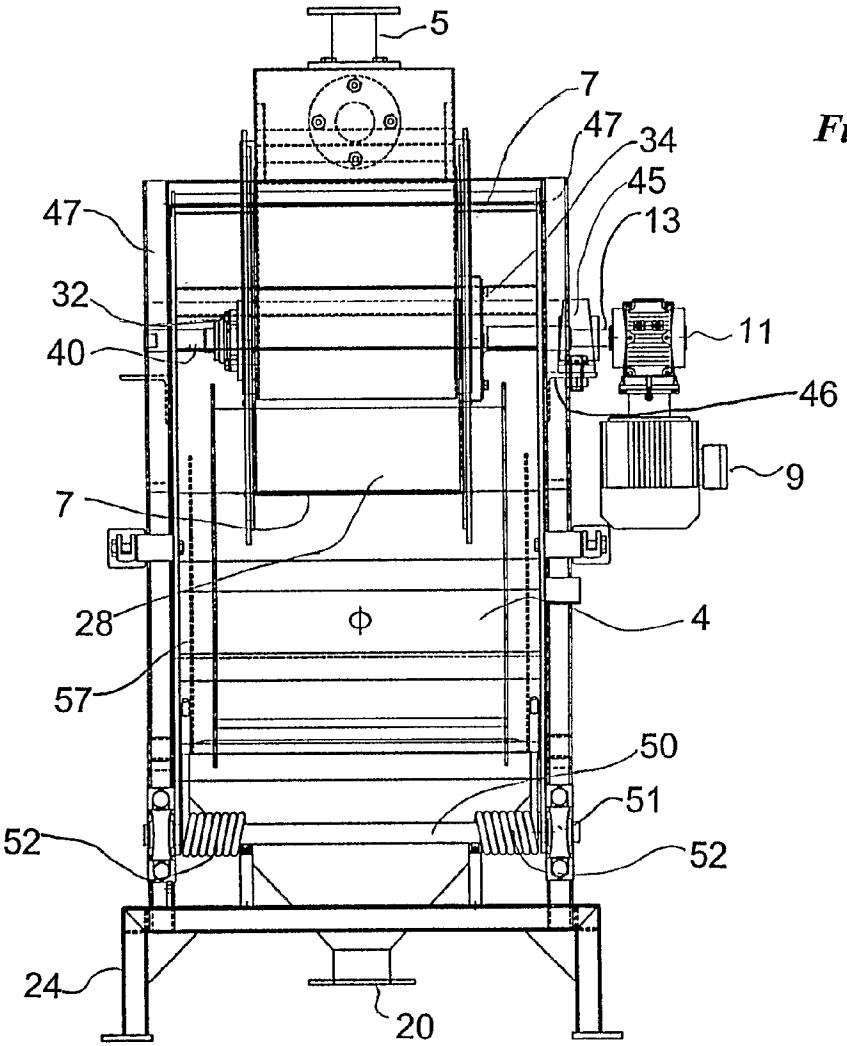
FIG. 2 shows an end on elevation of the separator of FIG. 1.
Figure 3:
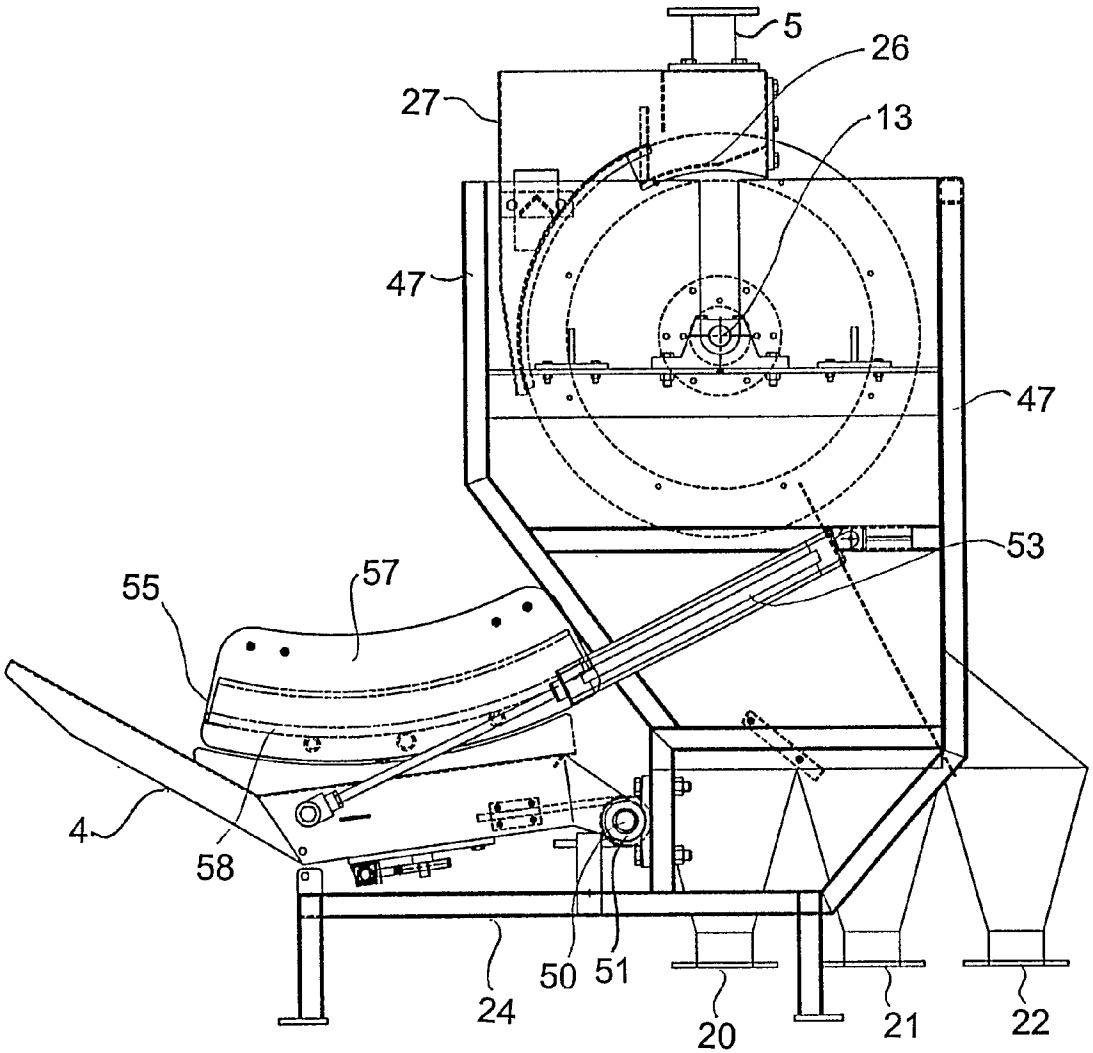
FIG. 3 shows a side on elevation of the separator of FIG. 1 with cover opened.

The various elements identified by numerals in the drawings are listed in the following integer list.

INTEGER LIST

1 Magnetic separator
3 Housing
4 Cover
5 Inlet
7 Drum assembly
9 Motor
11 Gear box
13 Drive shaft
15 Launder
16 Launder
17 Launder
20 Outlet
21 Outlet
22 Outlet
24 Support stand
26 Flow plate
27 Feed cover
28 Drum
30 Flange
31 Cover
32 Bearing
33 Magnet assembly
34 Outer plate
35 Primary magnet element
36 Secondary magnet element
37 Tertiary magnet element
38 Opening
39 Mounting plate
40 Stub shaft
41 Hub
42 Secondary stub shaft
45 Mounting block
46 Cross member
47 Frame member
50 Shaft
51 Bearing
52 Spring
53 Pneumatic cylinder
55 Sieve assembly
57 Side wall
58 Screen
59 Frame
60 Mesh elements
61 Support members
62 Gap
63 Front face
64 Rear face Referring to FIGS. 1 to 4, there is shown a magnetic separator generally designated 1 having a housing 3 provided with a tiltable cover 4. The magnetic separator is mounted on a support stand 24.

The top of the housing is provided with an inlet for a feed such as a slurry of crushed rock with water.

The inlet is located above a drum assembly 7, the inlet being arranged so that slurry being fed to the magnetic separator via the inlet falls upon the flow plate 26 and then flows down over the drum 28 forming part of the drum assembly. A feed cover 27 is provided at the upper part of the magnetic separator.

A motor 9 acting through gear box 11 and drive shaft 13 is arranged to rotate the drum assembly.

Three launders 15, 16 and 17 are provided in series beneath the drum to receive various streams coming off the drum, namely a non-magnetic fines stream for the launder 15, a non-magnetic coarse stream for the launder 16 and a magnetic stream for launder 17. The launders have the outlets 20, 21 and 22 respectively.

Figure 5:
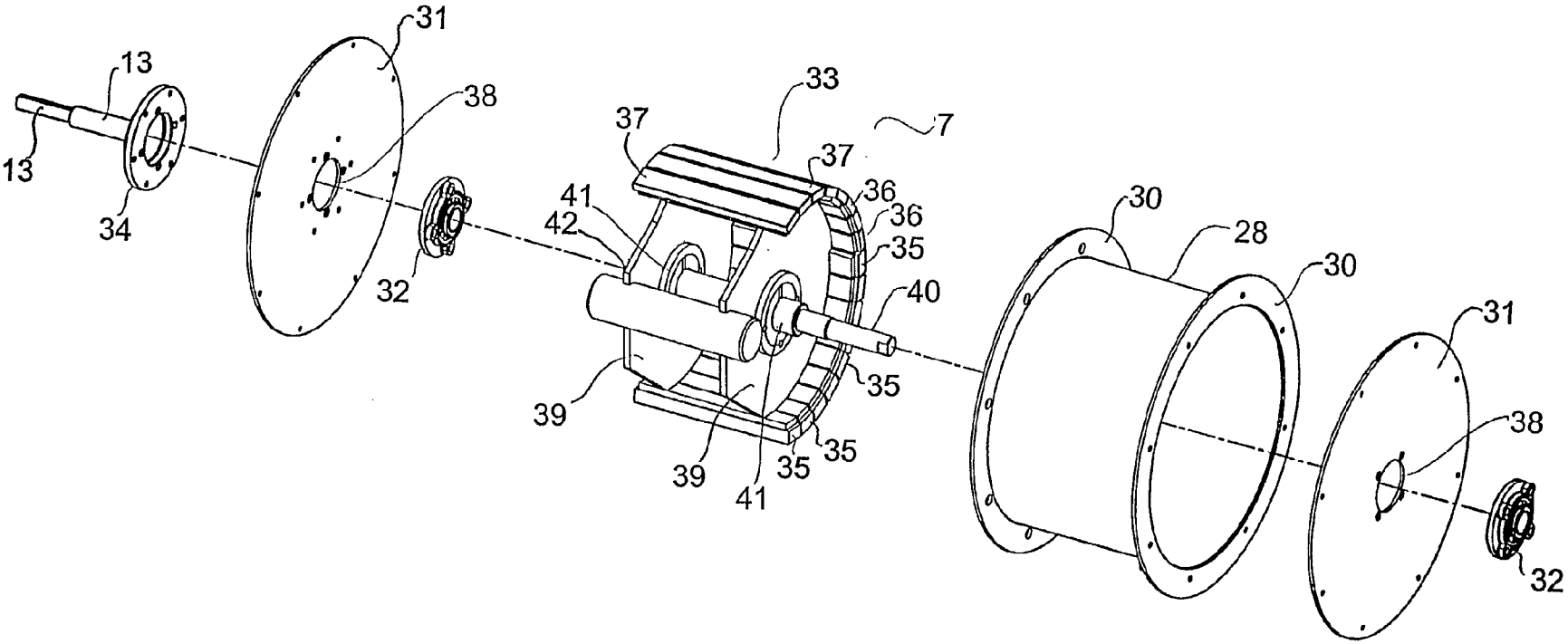
FIG. 5 shows an exploded view of the rotating drum used in the separator of FIG. 1.

The drum assembly shown in detail in FIG. 5, comprises a stainless steel drum 28 which provides an attraction surface to which magnetic particles in the feed are attracted.

Opposite sides of the drum are provided with a circumferential flange 30. A cover 31 is provided on each of the opposite ends of the drum. Each cover 31 is connected to the respective flange and bearings 32 fit over the openings 38 in the covers 31.

As can be seen in FIG. 5, the bearing 32 on the right hand side of the drawing fits over the stub shaft 40 which is secured to the magnet assembly 33. In turn, the stub shaft 40 is fixed to a frame member 47 of the magnetic separator. The connection between the two is such as to secure the magnet assembly 33 against rotation.

Looking at the opposite side of the drawing in FIG. 5, it can be seen that the drive shaft 13 by connection with the outer plate 34 and cover 31 rotationally drives the drum.

A short secondary stub shaft 42 which is not visible in FIG. 5 but it is located in line with the bearing 32 on the left side of the drawing of FIG. 5 projects into the bearing 32 and provides support for the magnet assembly 33 in association with the support provided by the stub shaft 40 on the opposite side of the magnet assembly. The drive shaft 13 is also mounted via the mounting block 45. The mounting block 45 is mounted via a cross member 46 extending between frame members 47.

The magnet assembly 33 comprises a number of magnet elements which are mounted on the mounting plates 49.

The magnet elements comprise a number of primary magnet elements 35 which are of maximum strength followed by a number of secondary magnet elements 36 of the same or lesser strength than primary magnet elements 35. In turn, even weaker tertiary magnet elements 37 are arranged beyond the primary and secondary magnet elements.

Figure 4:
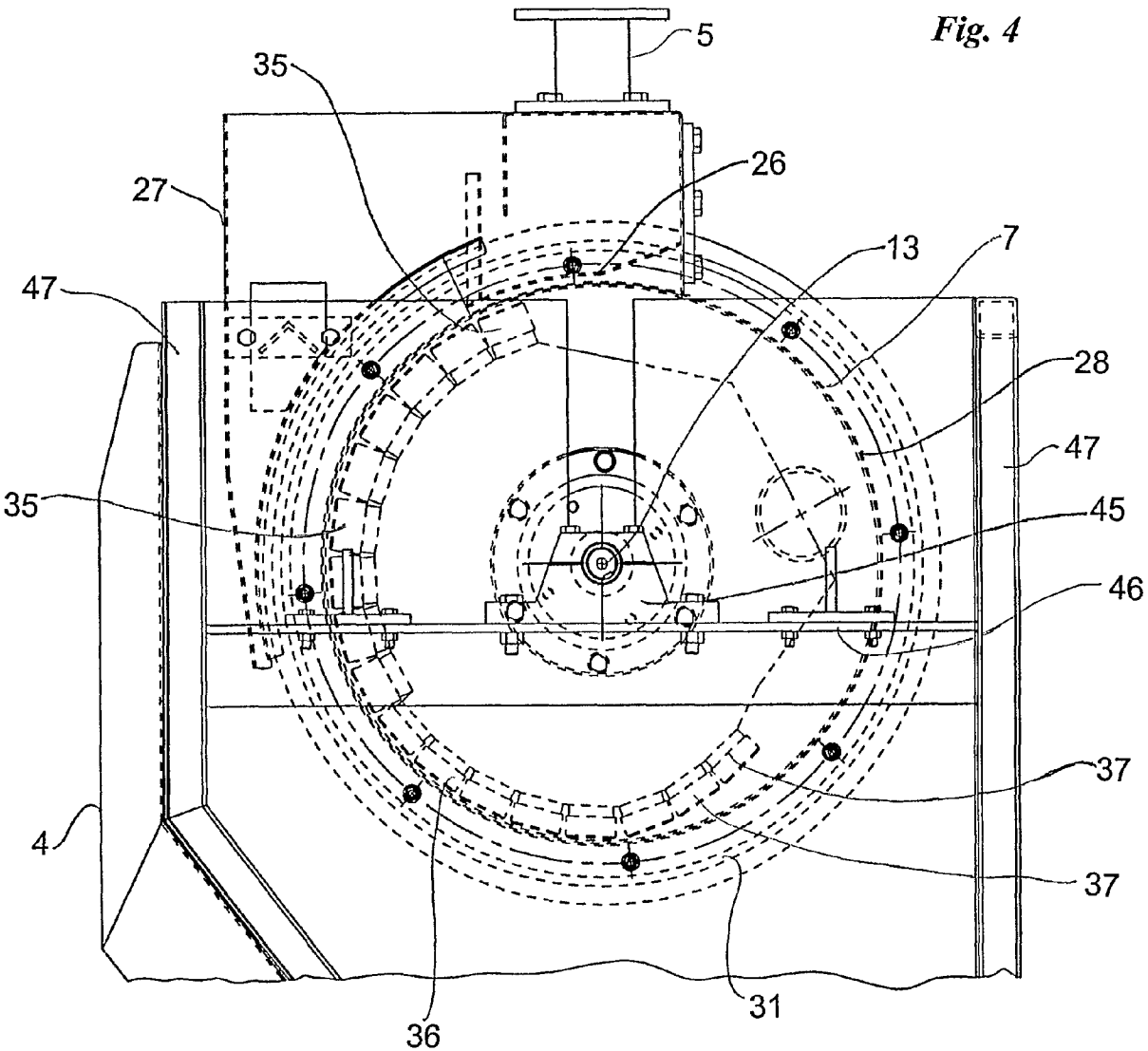
FIG. 4 shows an enlarged view of the rotating drum within the separator of FIG. 1.

It can be seen that the magnet elements define an arc which follows the interior outline of the drum 28 with the exception that the final few tertiary magnet elements gradually extend away from the inner drum surface as shown more clearly in FIG. 4.

A number of the primary and/or secondary magnet elements have their magnetic field directions reversed with respect to their more adjacent elements for purposes to become apparent.

The cover 4, is mounted via the shaft 50 and bearings 51 on the frame members 47. Springs 52 are arranged to urge the cover to the closed position shown in FIG. 1. A pneumatic cylinder 53 is arranged to pivot the cover 4 to the open position shown in FIG. 3. The cover includes a sieve assembly generally designated 55. This comprises side walls 57 on opposite sides of a screen 58.

Figure 6:
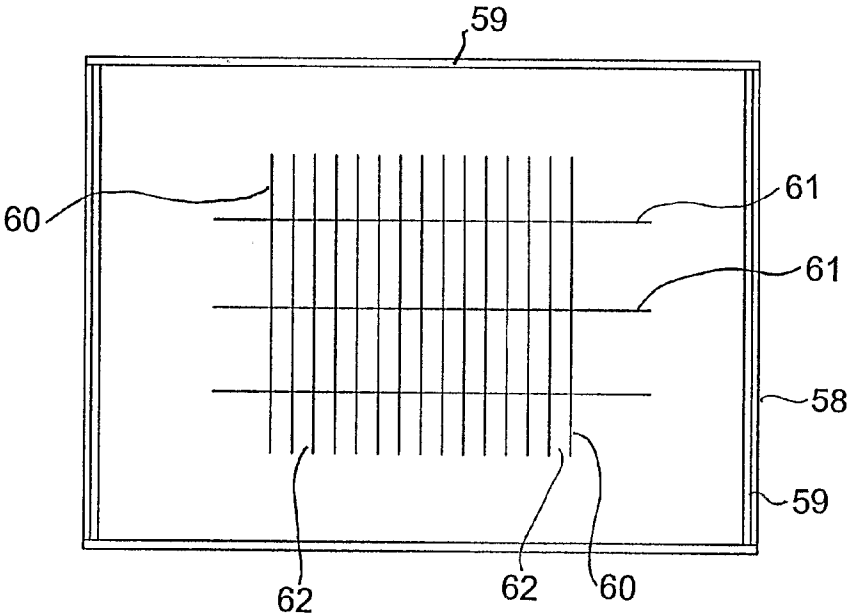
FIG. 6 shows a partial plan view of a mesh screen used in the separator of FIG. 1.
Figure 7:
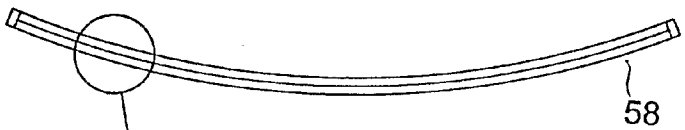
FIG. 7 shows an elevational view of the screen of FIG. 6.
Figure 8:
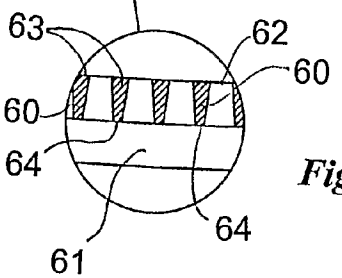
FIG. 8 shows an enlarged sectional view of the circled part of the mesh screen of FIG. 7.

The screen 58 shown in more detail in FIGS. 6 to 8, comprises a number of mesh elements 60 running parallel to each other and supported by a number of support members 61. The mesh elements and support members are in turn supported at the ends by the frame 59. The mesh elements are separated by a gap 62 which defines the desired sizing required for the feed. It should be noted that the front face 63 of the mesh elements is broader than the rear face 64 in order to reduce the likelihood of particles "hanging up" within the gap between the mesh elements.

The construction of the cover and associated sieve assembly is such that the direction of the screen 58 can be reversed by opening the cover, lifting out the screen and simply turning it around. This has the advantage that wear and tear on the leading edges of the mesh elements can be shared between both sides of the mesh elements rather than a single side as would be the case with a fixed mesh screen. Thus the longevity of the screen is substantially enhanced.

In normal operation of the magnetic separator, a water-based slurry of feed containing entrained magnetic components enters through inlet 5 and is allowed to flow across the flow plate 26 onto the outer surface of the stainless steel drum 28 in proximity to the first of the primary magnet elements.

The strong magnetic field of the primary magnet elements attracts magnetic materials to the outer surface of the rotating drum and so the attracted magnetic materials rotate with the drum in an anticlockwise direction.

As the drum continues to rotate, the magnetic particles attracted to the outer surface of the drum are subjected to a reversal in magnetic polarity as they pass by various of the magnet elements having polarity reversals. This has the effect of agitating the attracted magnetic components sitting on the drum surface. As a result, entrained non-magnetic material is shaken free of the magnetic components and falls off the drum. As the magnetic materials continue to rotate with the drum towards the secondary and tertiary magnet elements, the degree of magnetic attraction is gradually decreased with the result that the magnetic materials fall off the drum quite readily as the surface of the drum passes beyond the last of the magnetic elements. The fact that the magnetic attraction is gradually decreased by reducing the strength of the magnet elements and also by increasing their distance from the drum surface means that the magnetic components do not tend to clump or ball up and hence fall off the drum surface in a more controlled manner. When they fall off the drum surface, they are collected by the launder 17 arranged so as to collect the magnetic materials and direct them through the outlet 22.

The non-magnetic materials fall onto the sieve assembly 55 and are screened so that the fines are directed into launder 15 and coarse non-magnetic elements are directed into launder 16. The launders 15 and 16 are associated with outlets 20 and 21 respectively.

Whilst the above description includes the preferred embodiments of the invention, it is to be understood that many variations, alterations, modifications and/or additions may be introduced into the constructions and arrangements of parts previously described without departing from the essential features or the spirit or ambit of the invention.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

The reference to any prior art in this specification is not, and should not be taken as, an acknowledgment or any form of suggestion that such prior art forms part of the common general knowledge in Australia.

The invention claimed is:

1. A magnetic separator for a mineral feed comprising, a cover, a rotatable drum having an attraction surface, an inlet for receiving a stream of the mineral feed and directing the mineral feed past the rotatable drum, means for generating a magnetic field to attract magnetic components in the mineral feed to the attraction surface, a sizing screen mounted on the cover and arranged to receive slurry falling off the rotatable drum, a primary launder arranged to receive fines passing through the sizing screen, a secondary launder arranged to receive a coarse component not passing through the sizing screen, and a tertiary launder arranged to receive magnetic material dropping from the rotatable drum wherein the magnetic field generating means are adapted to subject the magnetic components to at least one reversal of polarity of the magnetic field as the rotatable drum rotates and the cover is moveable toward and away from the rotatable drum.

2. The magnetic separator according to claim 1 wherein the inlet is arranged to direct the mineral feed past the rotatable drum by flowing the mineral feed over the rotatable drum.

3. The magnetic separator according to claim 1 wherein the magnetic field generation means comprise a plurality of individual magnet segments arranged in an arc generally following the interior surface of the rotatable drum, and one or more of the segments is arranged so that there is a polarity reversal compared with an adjacent segment.

4. The magnetic separator according to claim 3 wherein the magnetic field strength applied to the rotatable drum by the magnet segments at one end of the arc nearest where the feed first passes after being directed onto the rotatable drum is at a maximum and decreases to a minimum as applied to the rotatable drum at the other end of the arc.

5. The magnetic separator according to claim 1 wherein, the cover is pivotally mounted so as to permit the cover to be pivoted toward and away from the rotatable drum.

6. The magnetic separator according to claim 1 comprising, spring means arranged to urge the cover towards the rotatable drum, and a pneumatic cylinder arranged to pivot the cover away from the rotatable drum when activated.

7. A magnetic separator for a mineral feed comprising, a housing having a frame, a rotatable drum within the housing and having an attraction surface, and a cover connected to the frame and moveable toward and away from the rotatable drum, an inlet in the housing for receiving a stream of the mineral feed and directing the mineral feed past the rotatable drum, means for generating a magnetic field to attract magnetic components in the mineral feed to the attraction surface, a sizing screen mounted on the cover and arranged to receive slurry falling off the rotatable drum when the cover is moved toward the rotatable drum, a primary launder arranged to receive fines passing through the sizing screen, a secondary launder arranged to receive a coarse component not passing through the sizing screen, and a tertiary launder arranged to receive magnetic material dropping from the rotatable drum wherein the magnetic field generating means are adapted to subject the magnetic components to at least one reversal of polarity of the magnetic field as the rotatable drum rotates.

8. The magnetic separator according to claim 7 wherein the inlet is arranged to direct the mineral feed past the rotatable drum by flowing the mineral feed over the rotatable drum.

9. The magnetic separator according to claim 7 wherein the magnetic field generation means comprise a plurality of individual magnet segments arranged in an arc generally following the interior surface of the rotatable drum, and one or more of the segments is arranged so that there is a polarity reversal compared with an adjacent segment.

10. The magnetic separator according to claim 9 wherein the magnetic field strength applied to the rotatable drum by the magnet segments at one end of the arc nearest where the feed first passes after being directed onto the rotatable drum is at a maximum and decreases to a minimum as applied to the rotatable drum at the other end of the arc.

11. The magnetic separator according to claim 7 wherein, the cover is pivotally mounted so as to permit the cover to be pivoted toward and away from the rotatable drum.

12. The magnetic separator according to claim 7 comprising, spring means arranged to urge the cover towards the rotatable drum, and a pneumatic cylinder arranged to pivot the cover away from the rotatable drum when activated.

* * * * *